US007223062B1

(12) United States Patent
Emerson

(10) Patent No.: US 7,223,062 B1
(45) Date of Patent: May 29, 2007

(54) FRONT END LOADER TACTICAL BOOM APPARATUS

(76) Inventor: Earl William Emerson, P.O. Box 22, Christine, ND (US) 58015

( * ) Notice: Subject to any disclaimer, the term of this patent is extended or adjusted under 35 U.S.C. 154(b) by 0 days.

(21) Appl. No.: 11/064,690

(22) Filed: Feb. 23, 2005

(51) Int. Cl.
*B66C 1/00* (2006.01)

(52) U.S. Cl. ..... 414/729; 37/468; 414/723

(58) Field of Classification Search ..... 414/723, 414/729, 739, 740; 37/468
See application file for complete search history.

(56) References Cited

U.S. PATENT DOCUMENTS

| | | | | |
|---|---|---|---|---|
| 3,567,050 | A | 3/1971 | Pasquazzi | 214/147 |
| 4,776,524 | A | 10/1988 | Sakato | 241/101.7 |
| 4,799,852 | A | 1/1989 | Ramun | 414/724 |
| 5,894,666 | A | 4/1999 | Hrusch | 30/134 |
| 5,938,399 | A * | 8/1999 | Knutson | 414/722 |
| 6,470,606 | B1 | 10/2002 | Nagahiro et al. | 37/348 |
| 6,523,284 | B1 | 2/2003 | Clugston | 37/403 |
| 6,526,678 | B2 | 3/2003 | Waddington, Jr. | 37/406 |
| 6,619,906 | B2 * | 9/2003 | Dick | 414/723 |
| 6,634,173 | B2 | 10/2003 | Linster et al. | 60/484 |
| 6,655,899 | B1 * | 12/2003 | Emerson | 414/729 |
| 6,718,661 | B1 | 4/2004 | Miller | 37/403 |

* cited by examiner

*Primary Examiner*—Donald Underwood
(74) *Attorney, Agent, or Firm*—Curtis V. Harr

(57) ABSTRACT

A front end loader tactical boom apparatus providing a means of penetrating walls for the purposes of gathering intelligence and the dispensation of suppression agents. The tactical boom apparatus my be readily assembled at a given site with varying boom lengths and attachments including a claw head equipped with a camera and a means for delivery of tear gas, flash grenades and the like.

17 Claims, 8 Drawing Sheets

FIG 2
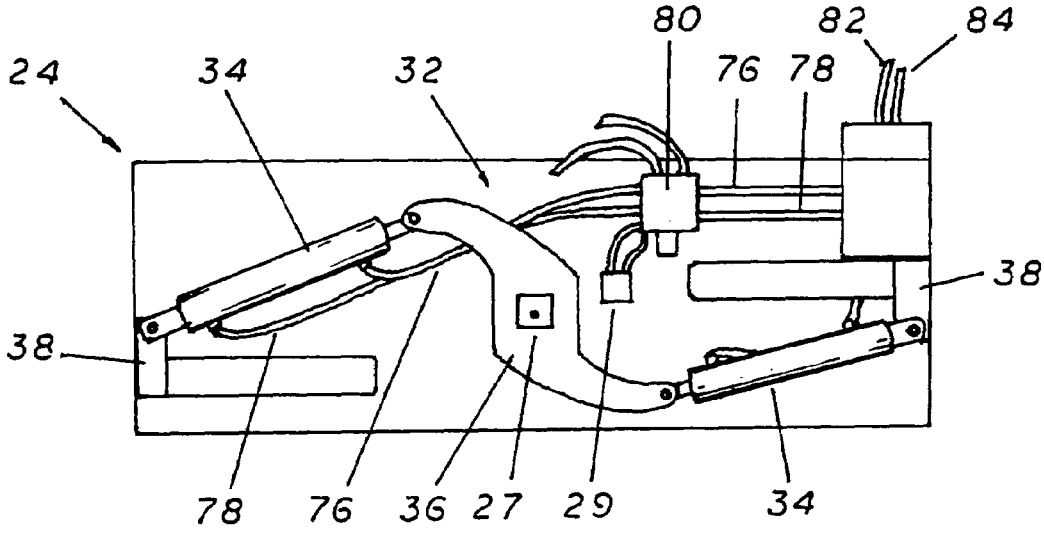
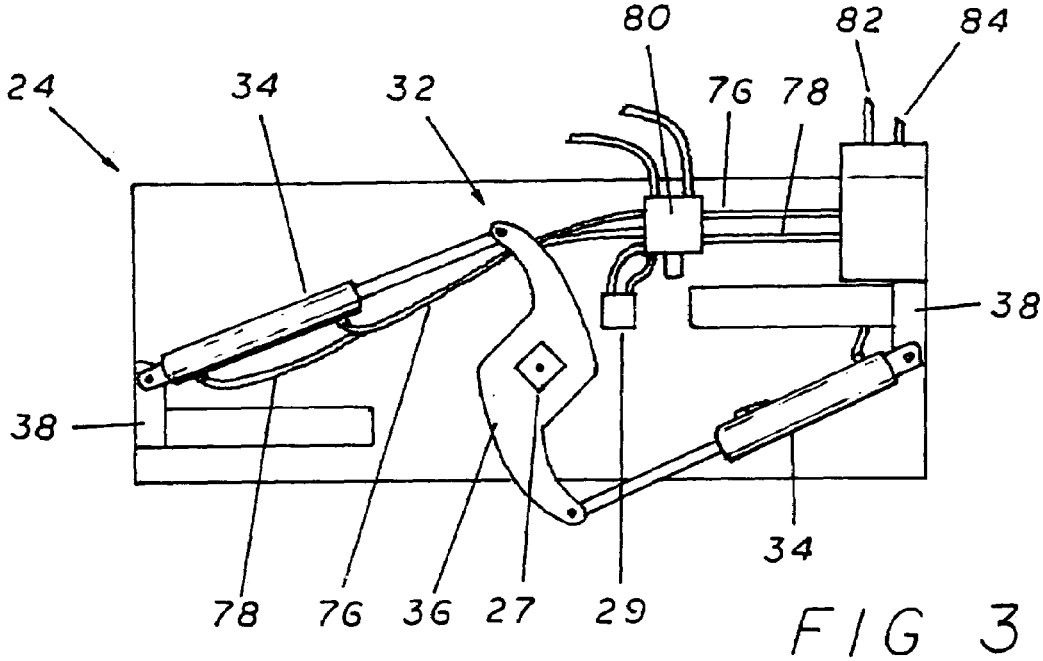
FIG 3

FIG 4
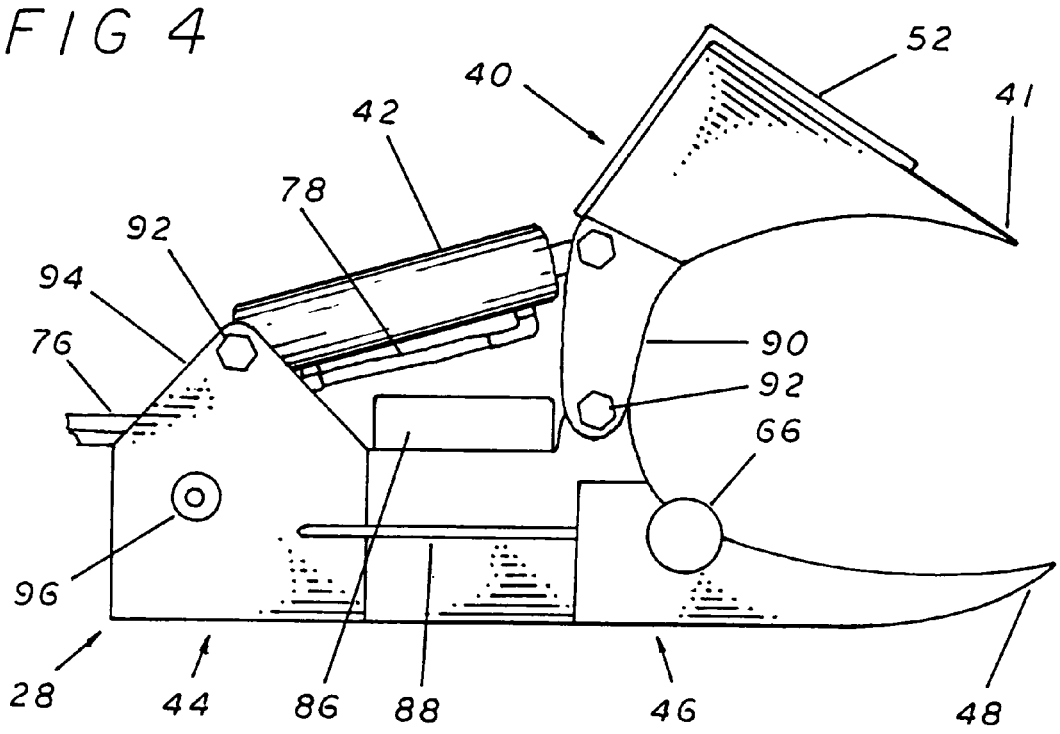
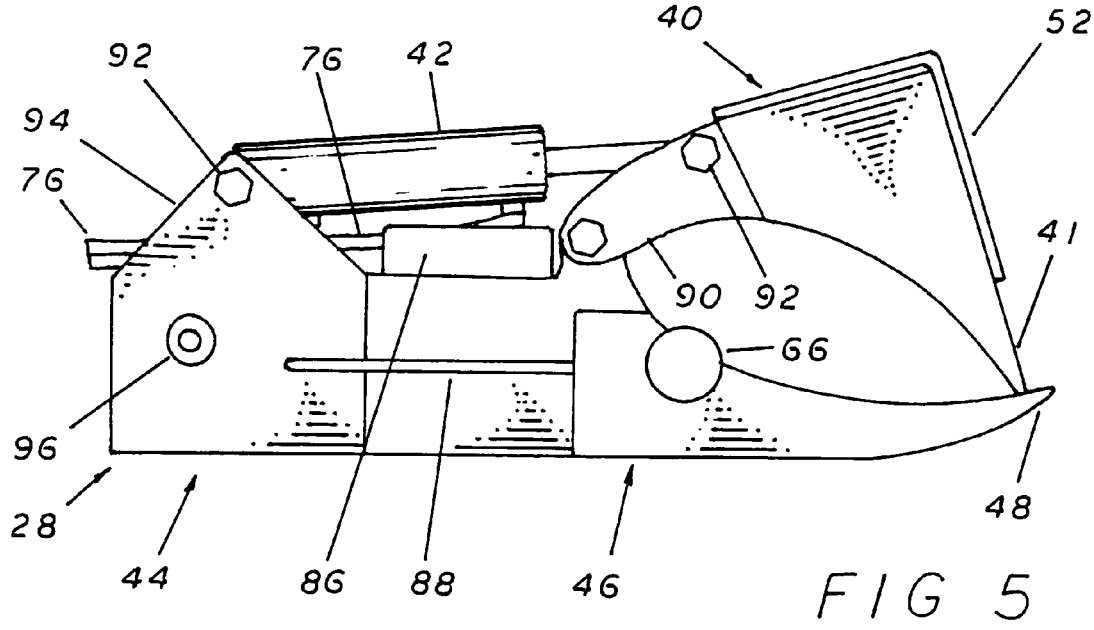
FIG 5

FIG 6
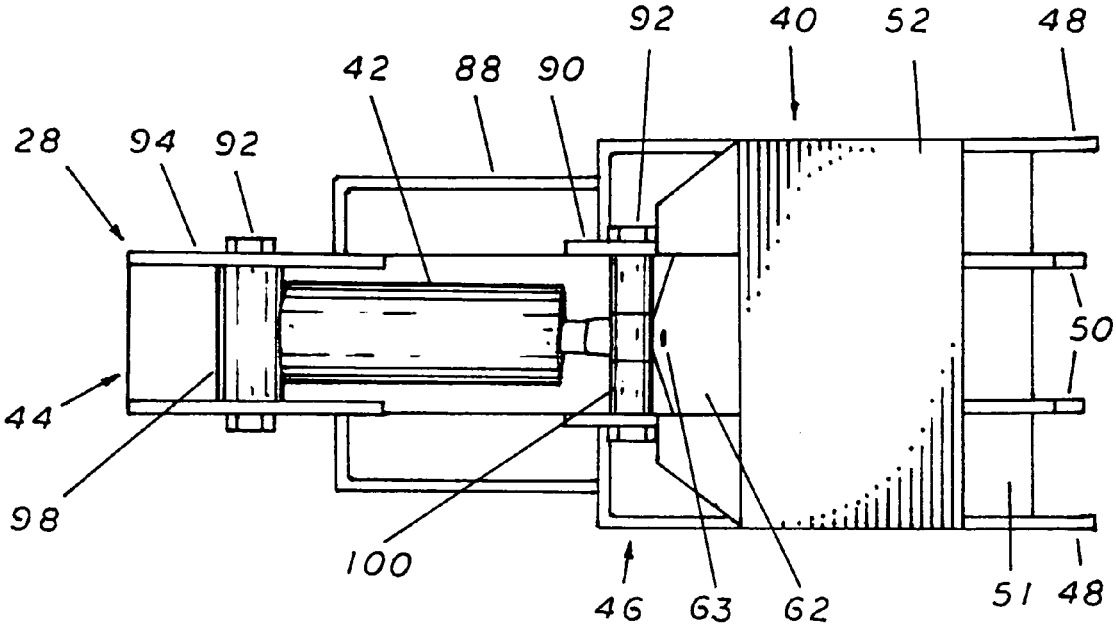
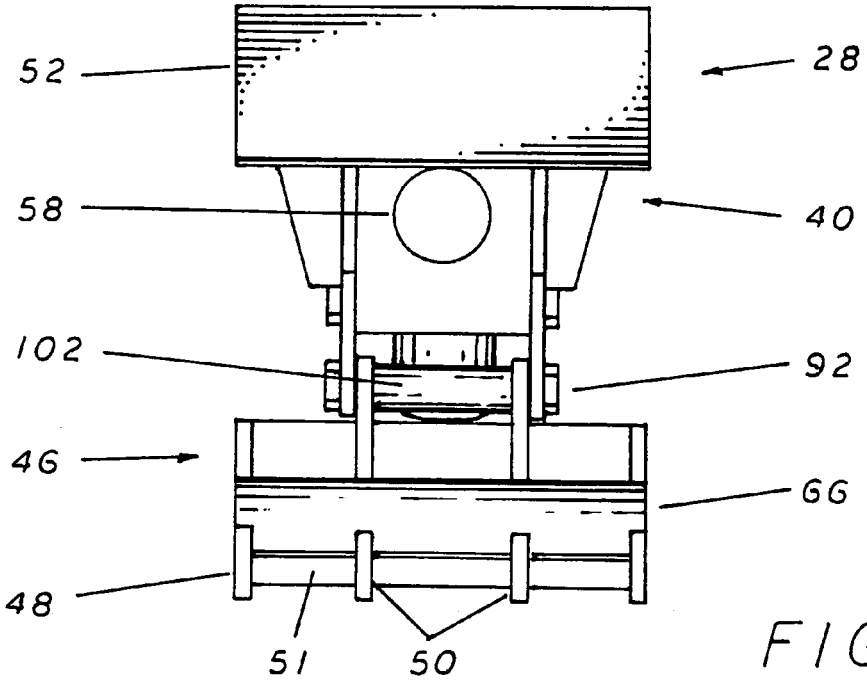
FIG 7

FIG 8
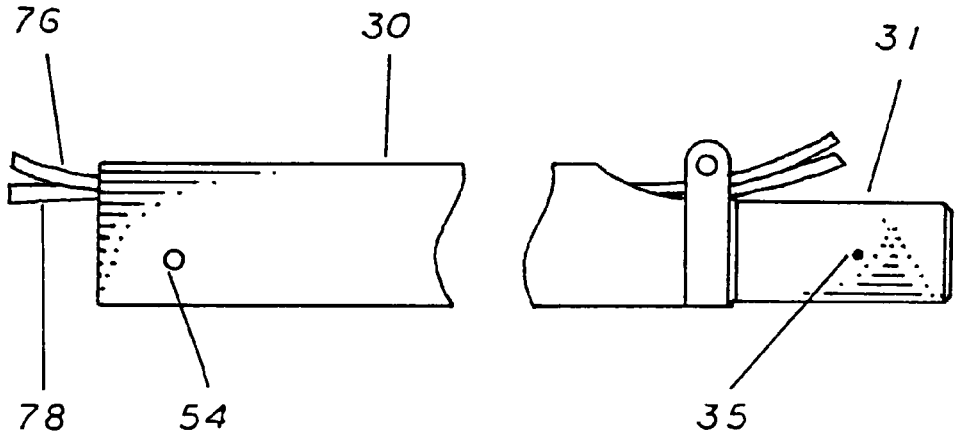
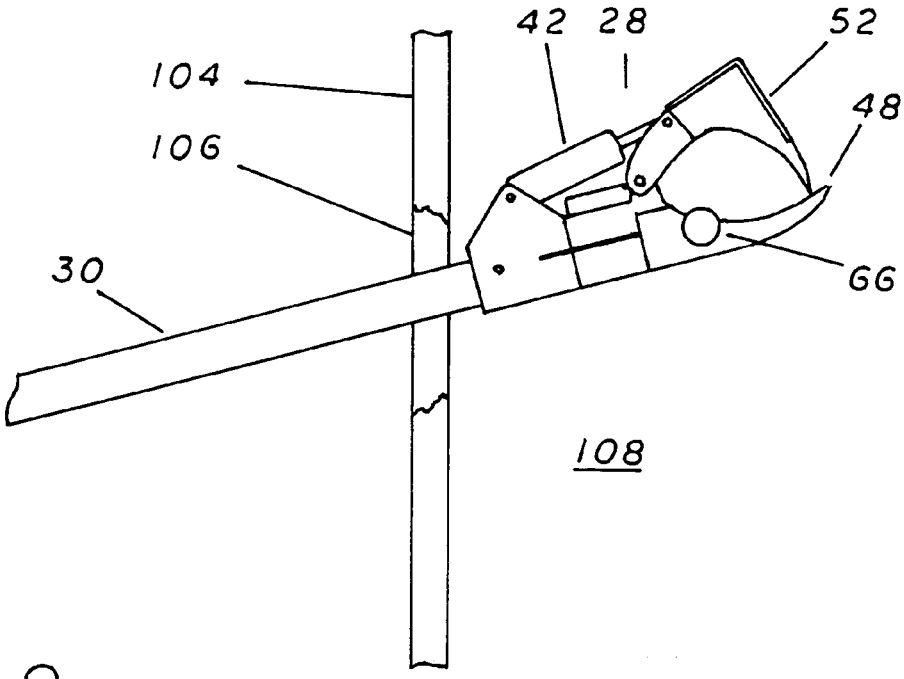
FIG 9

FIG 10
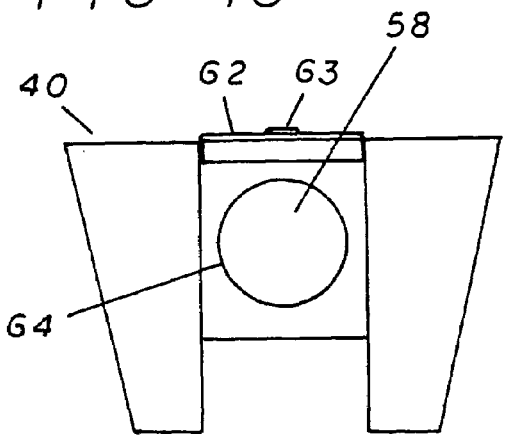
FIG 11
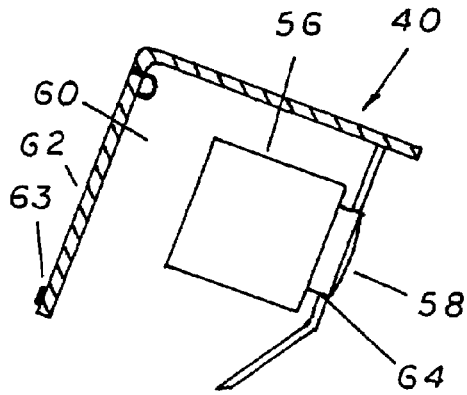
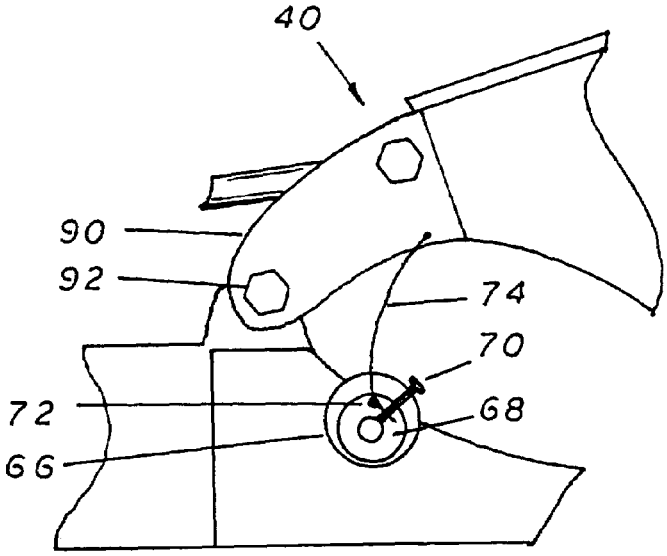
FIG 12

FIG 13
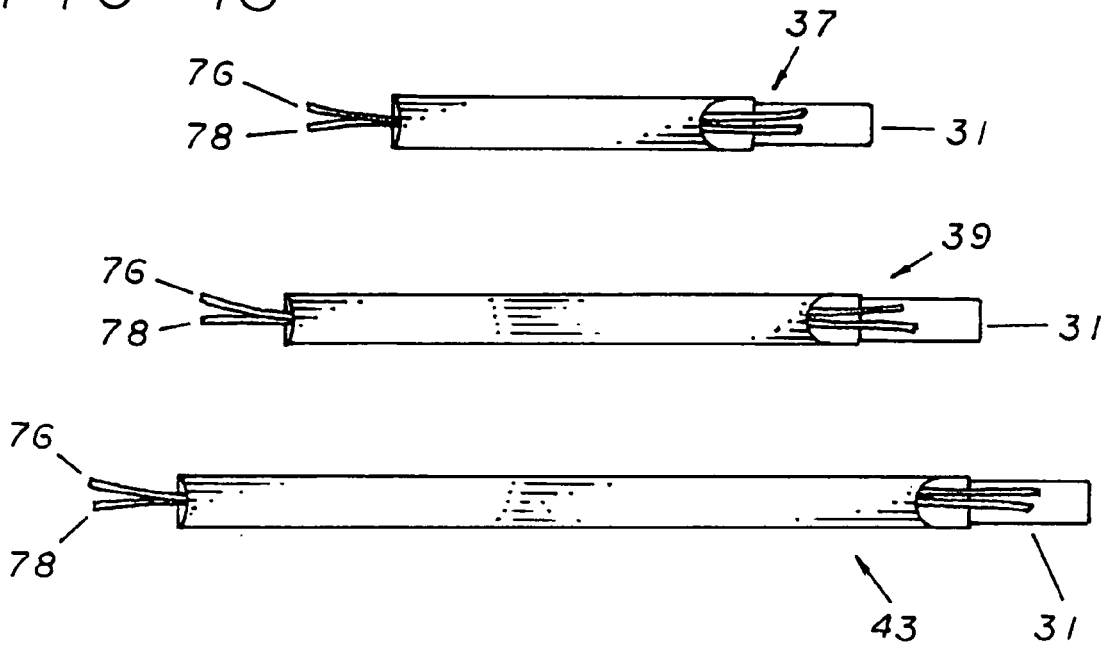
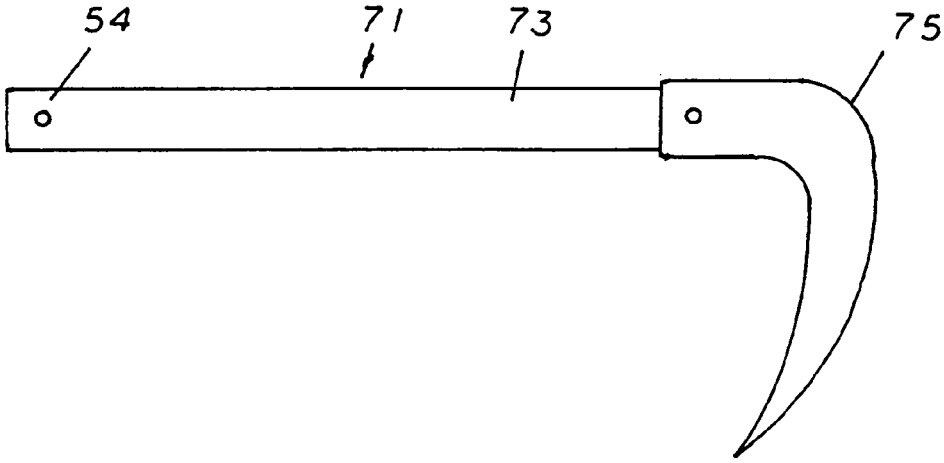
FIG 14

FRONT END LOADER TACTICAL BOOM APPARATUS

BACKGROUND OF THE INVENTION

The present invention relates to a front end loader attachment for use primarily in conjunction with utility skid steer loaders. More specifically, to such a front end loader attachment being comprised of a plurality of specifically designed tools which can be mounted to an outwardly extending boom and employed in a variety of differing situations all of which stem from the unique requirements of dealing with the threatening or dangerous situations faced by bomb squads, police force SWAT teams, certain military forces, and arson investigations teams.

In recent years the use of skid steer loaders has become very popular in many industries. Skid steer loaders are small vehicles, typically having four wheels or a pair of tracks, which steer the vehicle by varying the speed of each individual wheel or track. Due to the unique steering method, skid steers are easily maneuverable in tight quarters. Thus, skid steer loaders have proven to be very efficient and necessary in many work situations having limited space.

As skid steers have increased in popularity, manufacturers have found it profitable to make large numbers of attachments for the front of skid steer loaders. These attachments include snow blowers, sandbagging devices, log moving equipment, buckets, hole drilling equipment, and the like. The various attachments are limited only by the ability of the skid steers and the user's needs. However, a potential use for these skid steer loaders and their numerous attachments is in certain dangerous circumstances often encountered by members of the police force, some military personnel, and arson investigators.

One of the problems often encountered by these types of forces is the necessity of entering an enclosed building or other hidden area while lacking an exact knowledge of what, or who, is within that space. This problem has been dealt with in the past by the development of specialized tactics by which a group of highly trained individuals stormed the space. This process is completed by this force occupying and securing the space thereby removing or neutralizing any threat contained therein.

While this method of securing these hidden spaces has proven effective over time it is far from perfect. First, it places the members of the infiltration force at a relatively high degree of personal risk. No matter how highly trained such a group may be, unforeseen circumstances can, and sometimes do, lead to losses in the group's members mostly stemming from the lack of knowledge of what is actually contained within the hidden space. Additionally, in part due to the inherent dangers involved in this type of maneuver, the turn over in the individual members comprising the group is often quite high. This turn over can then lead to more mistakes being made during the interdiction process thereby increasing the risks to the participants. Finally, unnecessary collateral damage can also occur within the hidden space during the storming process. As above, the collateral losses are also mostly attributable to the lack of knowledge of exactly what and who is concealed within the space prior to the beginning of operations.

A number of solutions for these problems have been proffered with varying degree of success. Most of these deal with the introduction of a remote control vehicle equipped with a camera into the hidden space to provide a reconnaissance function. While this is an effective method of obtaining information it suffers from two primary drawbacks. The first is that such systems tend to be expensive both in the necessary equipment and in the specialized training necessary for its proper operation. This expense tends to make these systems impractical in all but a very few of the possible applications. Secondly, the remote vehicles used in these systems are very difficult to protect and are therefore subject to interference by those that are the intended subjects of the surveillance. Thus, the use of remote vehicles for the reconnaissance of hidden areas suffers from flaws which to date, make them impractical for the uses described above.

Additionally, other similar problems exist in many of the situations encountered by these types of forces including the need to form large breaches in walls to provide access to the area behind it, the placement of shaped charges against walls or doors to again breach these structures, the removal of reenforced gates or fences, or other similar operations. As with the situation described above, there are methods employed by these groups which allow these circumstances to be overcome. However, there is at this time no one tool or unified system available that provides a means by which these obstacles can be overcame. Instead, it is necessary to either overcome them with specialized tactics and human force or with equipment specially designed for each circumstance. In the former approach the lives of the participants of these exercises are placed at risk or the procurement and maintenance of the of the specialized equipment in the latter places an extreme burden on the governmental body involved.

The specialized situations described above provide an opportunity for the use of a skid steer loader (or other similar vehicles) to position a specially designed apparatus into such hidden areas, to breach a wall, or to tear down a fence or gate. Especially when these hidden areas are potentially highly dangerous containing threats from unknown sources and of unknown quantities or the nature of the job itself (breaching a wall) has inherent dangers. The use of such vehicles in this application would provide solutions to many of the problems described above in a cost effective manner and would require little if any additional training to be operated by the general population of the groups involved.

Therefore, from the above discussion it can be seen that it would be desirable to provide a method of obtaining information from a hidden space, to breach a wall, or to remove a reenforced section of fence or gate without subjecting the members of a special operations force to the dangers inherent in the forceful occupation of such an area. Additionally, it can be seen that it would be desirable to provide such a mechanism that could be easily attached to the forward end of a common skid steer loader thereby allowing for its successful operation by any person obtaining the skill necessary to operate the skid steer. Further, it can be seen that it would be desirable to provide such a mechanism that would allow for the remote removal of potentially dangerous material from a site that would allow for thorough investigation without endangering the operator. Still further, it can be seen that it would be desirable to provide such a mechanism which is equipped with an observational device such as a still or video camera which can be controlled from a remote location. Finally, it can also be seen that it would be desirable to provide such a mechanism which is capable of delivering suppression devices such as tear gas from a safe and remote position.

SUMMARY OF THE INVENTION

It is the primary objective of the present invention to provide a means of obtaining information from a hidden space, to breach a wall, or to remove a reenforced section of fence or gate without subjecting the members of a special operations force to the dangers inherent in the forceful occupation of such a hidden area.

It is an additional objective of the present invention to provide such a mechanism for obtaining information from hidden areas, the breaching of walls, or the removal of sections of fencing or gates that could be easily attached to the forward end of a common skid steer loader thereby allowing for its successful operation by any person possessing the skill necessary to operate the skid steer loader.

It is a further objective of the present invention to provide such a mechanism that would allow for the remote removal of potentially dangerous material from a potential crime scene that would allow for thorough investigation without endangering the operator.

It is a further objective of the present invention to provide such a mechanism for obtaining information from hidden areas which can be equipped with an observational device such as a still or video camera which is controlled from a remote location.

It is a still further objective of the present invention to provide such a mechanism for obtaining information from hidden areas which is capable of delivering suppression devices such as tear gas from a safe and remote position.

These objectives are accomplished by the use of a frame and boom apparatus that is attached to the most forward ends of the loader arms of a skid steer loader. Often, it is desirable to employ a specialized skid steer loader that has been specially modified for use in these types of environments. This modification process is generally accomplished by the use of steel armor enclosing the driver's compartment and other vital areas of the skid steer loader. In order to accommodate the extra weight of the armor, the modified skid steer loader is often equipped with a track drive system. The track drive system accomplishes this function by spreading the weight of the vehicle over a much larger area than the traditional wheeled vehicle. However, in all other characteristics it operates in the same manner as the wheeled variety and therefore requires little or no additional training to operate.

The frame and boom apparatus serves as a platform upon which the primary component of the present invention can be mounted. This component of the invention is the claw head which is fixedly positioned on the most forward end of the boom and is the component employed to gain access to the specified hidden area. The claw head and boom components of the present invention are designed and manufactured in such a manner so that they may be easily and quickly attached in the desired positions relative to one another as well as the skid steer loader. This manner of construction allows the configuration of the present invention to be altered (most notably the length of the boom) to fit the requirements of any given situation. More specifically, the present invention is most commonly equipped with a plurality of booms of varying lengths which can be either employed separately or in conjunction with one or more of the other booms. This provides a means by which the length of the boom to fit any given situation.

The mounting of the present invention to the skid steer loader employs a pivotal mounting system which is employed in the attachment of the boom to the skid steer loader. This method of attachment allows the operator of the skid steer loader to not only position the claw head component of the present invention in the desired location, but also to manipulate it and the boom rotationally around the central axis of the invention. This feature of the present invention is especially useful when the claw head is employed in the grasping and manipulation of objects in both a vertical and horizontal orientation and all other possible positions between. Additionally, the rotational ability of the attachment of the present invention also allows items carried within the claw head to be discarded by the rotation of the boom. This ability thereby enhances the flexibility of the present invention and the skid steer loader.

The rotation of the pivotal attachment plate component of the present invention is accomplished through the use of a pair of pivot hydraulic cylinders. These pivot hydraulic cylinders are attached at their inner ends to the lower edges of the pivot plate and at its outer end to the attachment brackets located at the outside edges of the pivotal mounting assembly. These hydraulic cylinders are controlled by the skid steer operator through the skid steer's hydraulic system and the pressure and return hydraulic lines that are connected to it. By activating the cylinders they expand and force the pivot plate to rotate. This rotation of the pivot plate forces the attached boom to also rotate which in turn imparts this rotational force to the attached claw head of the present invention. Finally, the attachment apparatus is also equipped with a ball hydraulic valve system release. The ball hydraulic valve system release provides a mechanism by which the hydraulic pressure in the skid steer loader can be maintained when the hydraulic connections associated with the present invention are disconnected while changing components. Additionally, the ball hydraulic valve system release also ensures that pressure will not be entirely lost in the event of a system failure such a broken line or cylinder failure.

The attachment of the boom to the pivot plate is accomplished by the use of the receiver shaft that extends outward from the center of the pivot plate. This receiver shaft functions in the same manner as the receiver hitches employed in general vehicle applications and provides a quick and efficient manner of fixing an appropriate boom to the pivot plate. This design provides the present invention with a high degree of functional flexibility by allowing for the alteration of its configuration as needed thereby enhancing its use to its operators.

The claw head component of the present invention is constructed in such a manner so that it has an articulating upper claw member. This articulating upper claw member allows the forward portion of the claw head to open and close enabling it to grasp, lift, and move varying articles from one place to another. This opening and closing ability is provided by the attached claw hydraulic cylinder which is pivotally attached at one end to the rear portion of the claw head body and at the other to the upper claw member. The hydraulic pressure necessary to operate this hydraulic cylinder is provided from the skid steer through a series of hydraulic pressure and return lines.

The claw head is also specifically designed in such a manner that would facilitate its easy penetration of solid barriers such as the walls of buildings. In this purpose, the lower claw is equipped with four teeth which extend forward and which are constructed of extremely high strength steel. These teeth not only work in conjunction with the upper claw and its two upper teeth in the grasping function of the present invention, but also are functional in the wall penetration function. In this function, the two outer teeth are longer than the two inner teeth. This design enhances the penetration of surfaces as the lesser amount of resistance encountered by the two outer teeth (as opposed to all four) allows for their easier entering of the surface of the wall. An additional feature of the upper jaw is the battering ram which is a flat forward surface also made of high strength steel. The purpose of the battering ram is to engage the surface in such a manner so that it opens a large enough hole for the remaining portions of the present invention to easily pass through.

The battering ram also serves a second purpose having to do with the use of the shaped charges employed to blast entry holes into walls or the removal of doors. In this function, a shaped charge is attached to the outward face of the battering ram by any suitable means. With this accomplished, the operator employs the present invention to place the shaped charge in a position that will facilitate the desired effect upon detonation of the charge. The manner of construction of the claw head in general the battering ram specifically (being constructed of extremely high strength steel) allows them to withstand the force of the blast. Thus, the use of the claw head for this purpose allows for the precise placement of the shaped charge from a position of safety thereby lessening the dangers associated with this procedure.

The present invention is also equipped with two additional features that enhance its designed function. The first of these is a remotely controlled wide angle lens camera that is housed within the upper claw member. The camera is fitted within a central cavity which is closed off at the rear area by the pivoting cavity door. The forward portion of the central cavity is also fitted with a lens opening which provides the camera with a forward view of the area within which the present invention is positioned. The use of the wide angle lens provides the broadest view possible and eliminates any need to move the camera. Thus, the use of the camera within the upper claw member allows the operator of the skid steer to visually inspect an area that is normally hidden behind a wall.

The other feature of the present invention provides it with a suppression capability that is intended to compliment its observational uses. These suppression abilities are centered around the canister cylinder located laterally across the teeth of the lower claw. The canister cylinder is open at both ends provides the point within which suppression weapons such as tear gas canisters can be both contained and dispensed when necessary. The canister is positioned within the canister cylinder so that its handle remains outside of the cylinder. The handle is equipped with a pin which contains its contents until it is desirable to release it. The pin is in turn connected to the upper claw member by a pin cord. When the upper claw member is closed, the pin cord remains slack and the contents of the canister remain contained. However, by opening the upper claw member the pin cord draws the pin from the handle and the contents of the canister are released. Thus, the present invention can also be employed to introduce suppression agents into hidden areas without exposing the operator to any of the possible associated dangers.

An additional feature of the present invention is a boomed pick tool. The boomed pick tool is essentially a large single clawed apparatus that can be fitted either directly to the pivot plate at the forward end of a skid steer loader as described above or used in conjunction with one or more of the booms. The single claw, or pick head, is positioned on the terminal end of a pick boom from where it extends in a downward manner at a slightly more than ninety degree angle and which terminates in a relatively small point. The boomed pick tool is employed by the relevant governmental agencies to rip and tear structures when necessary or to probe specific areas from the safety of the skid steer loader.

Finally, the present invention is equipped with an additional apparatus to further enhance its performance in these specialized operations; the grapple. The grapple is another claw-like apparatus having a central body to which are pivotally attached two opposing arms. This pivotal attachment allows for the articulation of the arms which is facilitated by two hydraulic cylinders which are each in turn pivotally attached at their outer ends to the outside edge of one of the arms and at their inner ends to either side of the central body. This configuration allows the arms to be articulated by the application of hydraulic pressure supplied by the skid steer loader. The contraction and expansion of the hydraulic cylinders by the operator serves to open and close the claw arms to fit the requirements of a given situation.

The two arms of the grapple are generally of a hemispherical shape the inside surfaces of which are lined with a plurality of removable grasping teeth. The removable grasping teeth function to provide the grapple with a greater ability to grasp and lift cylindrical or spherical objects and as such are commonly constructed from a material such as a durable form of rubber. However, in some circumstances it is desirable to employ a system of gripping teeth that are more durable in nature. The removable nature of the grasping teeth provides a means by which they can be changed out to fit specific needs thereby enhancing the flexibility of the invention.

Additionally, the terminal end of each of these arms are equipped with inwardly extending penetration teeth that are configured in such a manner so that when the arms are in a partially opened position, there is a remaining gap between the opposing penetrating teeth. The penetrating teeth extend further inward than the grasping teeth and function not only to grasp objects by puncturing them, but also to help retain objects that are retained within the area defined by the inner surfaces of the grapple arms. Finally the penetration teeth also contain a canister hole into which a suppression agent, such as tear gas, may be placed.

The grapple is designed to be fitted to the terminal end of the booms of the present invention and so has many of the benefits of remote location and operation as described above. The grapple allows the operator to grasp and manipulate objects remotely thereby eliminating dangers associated with the procedure. Thus, the present invention represents an entire tool system designed to provide safe options to those members of government agencies that are presented with situations where it is necessary to monitor conditions hidden by an enclosed wall or to provide a means of entry when it becomes absolutely necessary. Additionally, the present invention is designed in such a manner so that each of its components function perfectly with all of the others and they all can be accessed and interchanged with the greatest possible ease.

For a better understanding of the present invention, reference should be made to the drawings and the description in which there are illustrated and described preferred embodiments of the present invention.

DESCRIPTION OF THE DRAWINGS

FIG. 2 is a front elevation view of the pivotal control and mounting apparatus of the present invention showing it as configured in the neutral position.

FIG. 3 is a front elevation view of the pivotal control and mounting apparatus of FIG. 2 illustrating its major components in the pivoted position.

FIG. 4 is a side elevation view of the present invention illustrating its manner of construction and the relative position of its major components.

FIG. 5 is a side elevation view of the present invention of FIG. 4 illustrating the position of its upper claw member when in the closed position.

FIG. 6 is a top elevation view of the present invention of FIG. 4.

FIG. 7 is a front elevation view of the present invention of FIG. 4.

FIG. 8 is a side elevation sectional view of a typical boom employed with the present invention and illustrating its manner of construction.

FIG. 9 is a side elevation view of the present invention being employed to penetrate a typical wall to gain access to the interior space.

FIG. 10 is a rear elevation view of the upper claw member component of the present invention illustrating the location of the central cavity and the means by which access is gained to it.

FIG. 11 is a side elevation cut-away view of the central cavity component of the present invention illustrating the positioning of the camera.

FIG. 12 is a side elevation view of the central portion of the present invention illustrating the location of the canister cylinder and the manner in which the canister is contained within it and the way it is operated to perform the desired function.

FIG. 13 is a top elevation view of the boom components of the present invention illustrating their varying lengths.

FIG. 14 is a side elevation view of the boomed pick apparatus component of the present invention illustrating its general configuration.

DESCRIPTION OF THE PREFERRED EMBODIMENT

Figure 1:
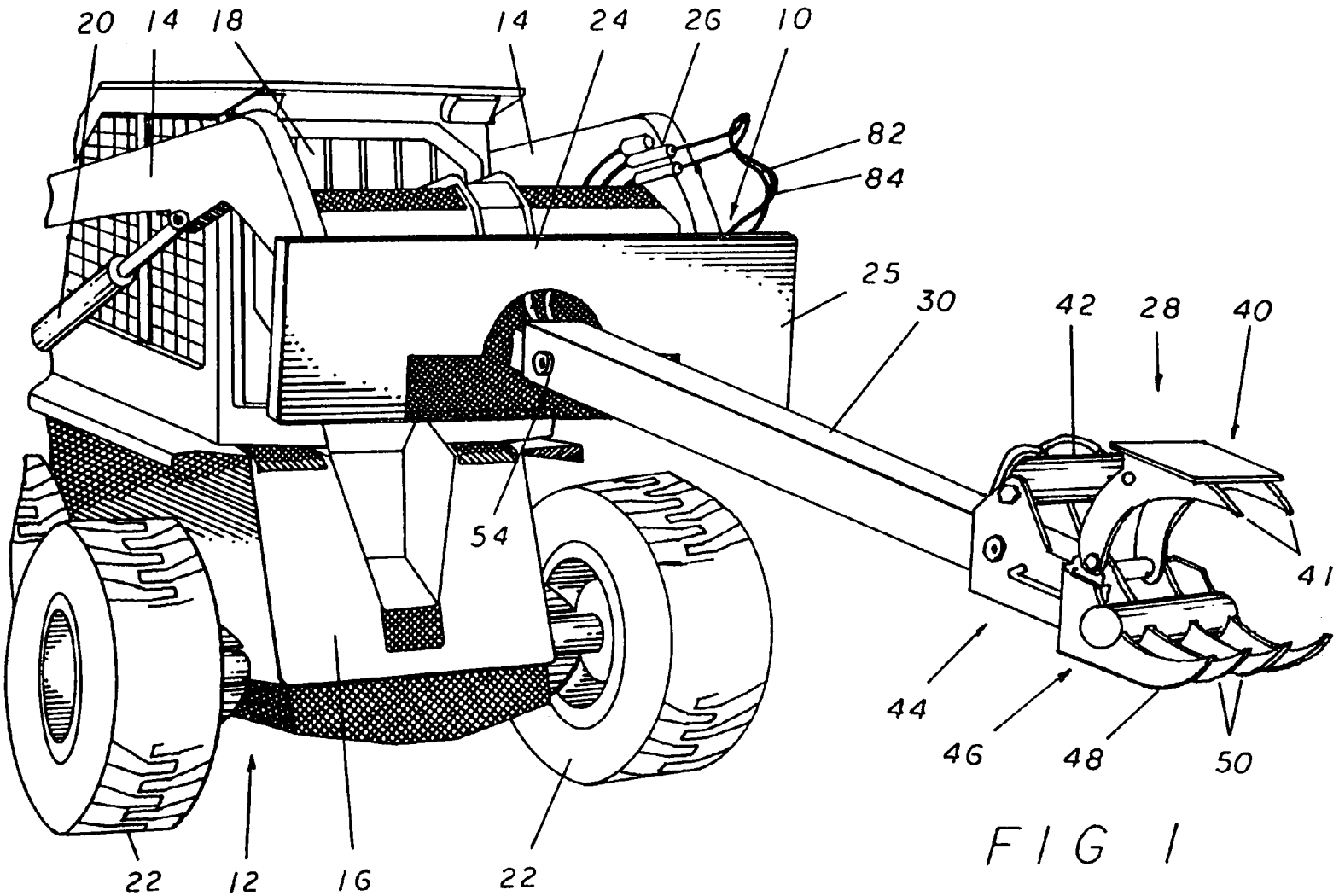
FIG. 1 is a perspective view of a typical skid steer loader being shown as equipped with the present invention on an extending boom.

Referring now to the drawings, and more specifically to FIG. 1, the front end loader tactical boom apparatus 10 is an accessory item intended to be used in conjunction with front end skid steer loaders 12 or other similar vehicles employed in like circumstances. However, for the purposes of simplicity all such vehicles will be referred to as front end skid steer loaders 12 hereinafter. Front end skid steer loaders 12 are typically highly maneuverable motor driven vehicles used to pick up and transfer raw materials having skid steer wheels 22 and loader arms 14 which are driven and controlled through the use of the loader arm hydraulic cylinders 20. The front end skid steer loaders 12 also generally consist of a loader body 16 to which all of its components are attached and which also contains the loader cab 18 within which the operator sits during the use of the present invention.

These vehicles are also equipped with a primary hydraulic assembly 26. The primary hydraulic assembly 26 is typically located towards the front of the skid steer loader 12 and is used in this application to provide the hydraulic pressure that is necessary to operate the present invention. This hydraulic pressure is transferred between the skid steer loader 12 and the present invention by use of the skid steer pressure and return lines, 82 and 84, which run forward to connect with the appropriate components of the present invention.

The present invention is attached to the forward end of the loader arms 14 by the use of the attachment assembly 24. The attachment assembly's 24 primary function is to allow for the proper positioning and control of the present invention. This is most commonly accomplished by the attachment of a boom 30 to the attachment assembly through the use of the boom attachment 54. The boom 30 then extends outward in a forward manner to a predetermined distance. The boom 30 in turn then provides the point of attachment at its most forward end for the claw head 28. The operational components of the attachment assembly 24 are generally enclosed within an assembly cover 25 to prevent damage occurring during operations. The boom 30 itself consists of a plurality of components which are further illustrated in FIG. 13. These components of the boom comprise a short boom 37, a medium boom 39, and the long boom 43. These separate pieces can be used in conjunction with the remaining components of the present invention either individually or in conjunction with one or more of the others. This flexibility allows the overall length of the boom 30 to be varied to fit foreseeable circumstance.

The claw head 28 is the primary functional component of the present invention and has a number of specialized components which operate to aid it in carrying out its intended purposes. The first of these is the claw head body 44 which not only provides for the attachment of the claw head 28 to the boom 30 but also the base to which the remaining components of the claw head 28 are fixed. The lower and forward portion of the claw head body 44 extends outward in the lower claw member 46 which in turn terminates at the forward most end of the present invention in the outer and inner teeth, 48 and 50. Additionally, the upper central portion of the claw head body 44 provides for the pivotal attachment of the upper claw member 40 which arcs upward and forward to terminate at the tips of two upper teeth 41.

The pivotal nature of the attachment between the claw head body 44 and the upper claw member 40 is facilitated by the use of the claw hydraulic cylinder 42 which is itself pivotally attached at its rearward end to the upper surface of the claw head body 44 and at its forward end to the central portion of the upper claw member 40. The use of the claw hydraulic cylinder 42 in this manner provides a means by which the upper claw member 40 can be articulated with reference to the lower claw member 46 providing capabilities to the present invention that will be discussed in greater detail below.

Referring now to FIGS. 2 and 3, the attachment assembly 24 is comprised of a number of components that are intended not only to provide a method of securing the present invention to a skid steer loader 12, but also to allow it to be manipulated in a pivotal manner. The accomplishment prior is well known within the industry and does therefore not warrant a specific discussion. However, the accomplishment of the second does affect the operation of the present invention and will therefore be discussed in more detail.

The pivoting nature of the attachment of the present invention is accomplished through the use of the pivotal mounting assembly 32 contained within the assembly cover 25. The pivotal mounting assembly 32 is comprised of a centrally located pivot plate 36 having two oppositely extending cylinder arms 33 and a centrally located receiver shaft 27 which facilitates the attachment of a boom 30 which in turn provides the base upon which the other components of the present invention are positioned. The outer most points of the cylinder arms 33 provide for the point of attachment for each of the inside ends of the two pivot hydraulic cylinders 34 which are in turn attached at their outer ends to the attachment brackets 38. The attachment brackets are in turn fixedly attached to the forward surface of the attachment assembly 24.

The pivot hydraulic cylinders 34 function to operate the pivoting action of the pivotal mounting assembly 32 which is facilitated through their attachment to the hydraulic system of the skid steer loader 12. The attachment is made through the skid steer pressure and return lines, 82 and 84, which connect to the hydraulic valve 80 positioned on the attachment assembly 24. The hydraulic valve 80 then is capable of diverting hydraulic pressure to either of the pivot hydraulic cylinders 34 though the appropriate hydraulic pressure and return lines, 76 and 78. When hydraulic pressure is supplied to the pivot hydraulic cylinders 34 as described, they each in turn expand and force the pivot plate 36 to rotate about its central axis. This will in turn impart this rotational motion to any apparatus that is itself attached to the pivot plate 36. Conversely, when the hydraulic pressure is released from the pivot hydraulic cylinders 34 they contract thereby reversing the rotation of the pivot plate 36 that was described previously. Thus, one use for the hydraulic pressure supplied by a skid steer loader 12 is to control the pivotal orientation of the present invention which has useful applications in the operation of the present invention that will be more fully described below.

Finally, the attachment assembly 24 is also equipped with a ball hydraulic valve system release 29. The ball hydraulic valve system release 29 is an apparatus that allows the hydraulic connections between the components of the present invention to be disconnected by relieving the hydraulic pressure. Thus, the use of the ball hydraulic valve system release 29 provides the most efficient manner for the changing between the varying apparatuses that make up the entirety of the present invention.

The general design and function of the claw head 28 component of the present invention are further detailed in FIGS. 4, 5, 6, and 7. As stated above, the claw head 28 is made up of a plurality of major components which operate in conjunction to perform the objectives of the present invention. In addition to these major components, a relatively large number of supplemental components also aid in these functions. The first of the major components is the claw head body which, as previously stated, provides for both the attachment of the claw head 28 to the appropriate apparatus but also provides the base for the remaining components of the claw head 28. The attachment of the claw head body 44 is facilitated by the use of the claw attachment hole 96 which corresponds with a similar device on the apparatus to which the claw head 28 is to be attached. Once these have been properly lined up, a fastening device such as a laniard pin is passed through to lock the two apparatuses in place. This design method allows the claw head 28 to be quickly attached or removed from its mount thereby enhancing the overall function of the present invention.

An additional component of the claw head body 44 is the cylinder bracket 94 which is comprised of two corresponding upwardly oriented plates that extend from the upper rearward surface of the claw head body 44. The cylinder bracket 94 provides for the pivotal attachment for the rear of the claw hydraulic cylinder 42. This attachment is accomplished through the use of a lower cylinder attachment 98 which spans the interior distance between the two sides of the cylinder bracket 94 and through which a bolt 92 is passed to hold it in place in a pivotal manner. The lower cylinder attachment 98 is in turn fixedly attached to the rear most surface of the claw hydraulic cylinder 42 and so serves to pivotally attach it to the claw head body 44. Just forward of the cylinder bracket 94 on the upper surface of the claw head body 44 are positioned two line guards 86. The line guards 86 are upwardly extending tabs of metal on either side of the upper surface which are designed to protect the hydraulic pressure and return lines, 76 and 78, during the operation of the present invention (as detailed in FIG. 5).

The forward portion of the claw head body 44 also serves as the point of attachment for the lower claw member 46. The lower claw member 46 is primarily made up of a plurality of forward extending claws which terminate in an upward curving point. Additionally, this plurality of claws in turn comprise a pair of outer teeth 48 and a further plurality of inner teeth 50. The outer teeth 48 are also slightly longer than the inner teeth 50 which enhances their penetrating ability which will be discussed in further detail below. The space between these teeth is also filled in to a point behind the termination of both the outer and inner teeth, 48 and 50, by the lower claw floor 51. The lower claw floor 51 allows the claw head to pick up and move smaller items such as small packages, small bombs, or mines which further enhances the utility of the present invention. Finally, the rear surface of the lower claw member 46 provides the point of attachment for the forward ends of the lift handles 88 which extend rearward from there and attach to the outer surface of the claw head body 44 after making a ninety degree turn. The lift handles 88 provide a means by which the claw head 28 can be lifted and transported when not attached to a boom 30.

The lower claw member 46 also provides for the placement of the canister cylinder which is located laterally across the claw teeth towards their rear and upper surfaces. The canister cylinder 66 performs a specific function in regards to the operation of the present invention which will be discussed in greater detail in conjunction with the description of later FIGURES.

The forward and upper surface of the claw head body 44 serves as the point of pivotal attachment for the upper claw member 40. This pivotal attachment allows the upper claw member 40 to pivot in relation to the lower claw member 46 which is pivotal to a number of functions the present invention is designed to accomplish. This pivotal attachment is accomplished through the design of the upper claw pivot bracket 90. The upper claw pivot bracket 90 is comprised of two parallel extensions of the lower surface of the upper claw member 40 that arc in a downward manner and which correspond in their distance from one another to that of the pivot tabs 91. The pivot tabs 91 are simply upward extensions of the upper and most rearward surfaces of the inner teeth 50. The pivotal attachment of the upper claw member 40 is accomplished at this point by the use of the claw pivot attachment 102 which spans the distance between the above described components of the attachment and through which a bolt 92 is passed to secure the pivotal attachment.

As previously stated, the pivotal nature of the upper claw member 40 is controlled by the use of the claw hydraulic cylinder 42 the rear portion of which is pivotally connected to the claw head body by methods previously described. Conversely, the forward end of the claw hydraulic cylinder 42 is in turn pivotally attached to the upper ends of the upper claw pivot bracket 90 by the use of the upper cylinder attachment 100 and a bolt 92 in the same manner as described for the other similar pivotal attachments. This manner of pivotally connecting the claw hydraulic cylinder 42 to both the upper claw member 40 and the claw head body 44 allows their orientation with respect to one another to vary as the upper claw member 40 is opened and closed. Therefore, the expansion and contraction of the claw hydraulic cylinder 42 serves to rotate the upper claw member 40 around this pivotal attachment in a controllable fashion by the operator of the present invention.

The upper claw member 40 also contains additional components which are critical to the operation of the present invention. The first of these is the battering ram 52 which is essentially a flat area of strengthened steel that is designed to contact a surface such as a wall in a parallel manner. Additionally, the battering ram 52 is oriented so that it may be positioned directly above the protruding outer teeth 48 when contacting a barrier. This design enables the battering ram 52 to expand the hole 106 in the wall 104 that was initiated by the outer teeth 48 of the lower claw member 46 (as best illustrated in FIG. 9). This expansion of the hole 106 then allows the claw head 28 to be positioned within the interior space 108 by the use of the boom 30.

The boom 30 (as detailed in FIG. 8) is the component of the present invention that is employed to extend the claw head 28 and its contained components into the desired position. The primary feature of the boom 30 is its length which in turn allows the claw head 28 to be deployed. It is important to note that while the boom is illustrated herein as being a fixed length, it can be constructed of any reasonable length desired. Additionally, more than one boom 30 may be used in sequence to add even more length and flexibility to the operation of the present invention. To facilitate its use, the rear end of the boom 30 is equipped with a boom attachment 54 which allows it to be fixed to either the skid steer loader 12 or another boom 30. In conjunction with this, the forward end of the boom 30 is constructed with a tapered attachment tongue 31 which allows that portion to be slid into either the claw head 28 or another boom 30. Additionally, the attachment tongue is equipped with an attachment hole 35 which corresponds in position and function to the claw attachment hole 96 on the claw head 28 or the boom attachment 54 on the boom 30. These connections are further enhanced by the use of a laniard pin that passes through the components and secures them in place. Finally, the boom 30 is also constructed in a manner that allows the hydraulic pressure and return lines, 76 and 78, to transverse the length of the boom 30 inside of it thereby protecting them from becoming damaged during the operation of the present invention.

Once the claw head 28 of the present invention has been positioned within the interior space 108 as described above, the last two components of the claw head 28 can be employed to complete its purpose. The first of these is the wide angle lens camera 56 the position and orientation of which are best illustrated in FIGS. 10 and 11. The wide angle lens camera 56 is some sort of remotely controlled image capturing device, taking still photos, moving images or both, that is housed within a central cavity 60 within the upper claw member 40. Its use of a wide angle lens allows for the broadest area of coverage making the complications of enabling camera movement unnecessary. The central cavity 60 has a cavity door 62 defining its rearward dimension and which also provides access to the central cavity 60, and any camera contained therein, to the operator of the present invention. Additionally, the forward edge of the central cavity 60 is equipped with a lens opening 64 through which the camera lens 58 can be aimed and focused to obtain the desired images. Finally, the cavity door 62 is a hinged cover that forms part of the back wall of the upper claw member 40 and which is open and closed by the operator by use of the door latch 63. Thus, the central cavity 60 is an entirely enclosed and protected portion of the upper claw member 40 which is used to house a wide angle lens camera 56. This camera 56 in turn provides the operator of the present invention with live pictures or video from an enclosed interior space 108 while enabling him to remain outside and safe.

The second of the final two components as described above is the canister cylinder 66 which is further detailed in FIG. 12. The canister cylinder 66 is the cylindrical component of the lower claw member 46 that is positioned perpendicularly to its outer and inner teeth, 48 and 50. The canister cylinder 66 is the component of the present invention that is employed to introduce suppression agents such as tear gas to a specific area. This is accomplished by inserting a tear gas canister 68 into the canister cylinder 66 in a manner so that the canister handle 70 and its associated canister pin 72 either remain outside of or are accessible from outside the canister cylinder 66. With this accomplished, a pin cord 74 extending from the canister pin 72 is fixedly attached to a surface on the closed upper claw member 40. As long as the upper claw member 40 remains in the closed position the pin cord 74 will remain slack and the canister will remain undisturbed. However, at the choice of the operator upper claw member 40 can be opened by the activation of the claw hydraulic cylinder 42 which in turn tightens the pin cord 74 and removes the canister pin 72 from the canister handle 70. The movement of the canister handle 70 releases the contents of the canister 68 thereby dispensing the tear gas in the desired location. Additionally, the operator can engage the rotational ability of the pivotal mounting assembly 32 as described above which will pivot the claw head 28 and dislodge the canister 68 from the canister cylinder 66. This enables the claw head 28 to be retrieved so that more suppression agents may be likewise deployed if necessary.

The present invention also comes equipped with a plurality of auxiliary components designed to perform specific tasks related to its operations. The first of these is the boomed pick tool 71 the construction of which is illustrated in FIG. 14. The boomed pick tool 71 is a single clawed apparatus, or the pick head 75, which is oriented in a downward manner in relation to its remaining components. Additionally, the pick head 75 is fixed to the outer end of a pick boom 73 which in its construction and function is similar to the boom 30 as described above. The pick head 75 extends downward at a slightly more than ninety degree angle and terminates in a relatively sharp point. The purpose of the boomed pick tool 71 is to rip and tear structures when necessary for the purpose of gaining access and to probe potentially dangerous areas from the safety of the skid steer loader.

Figure 15:
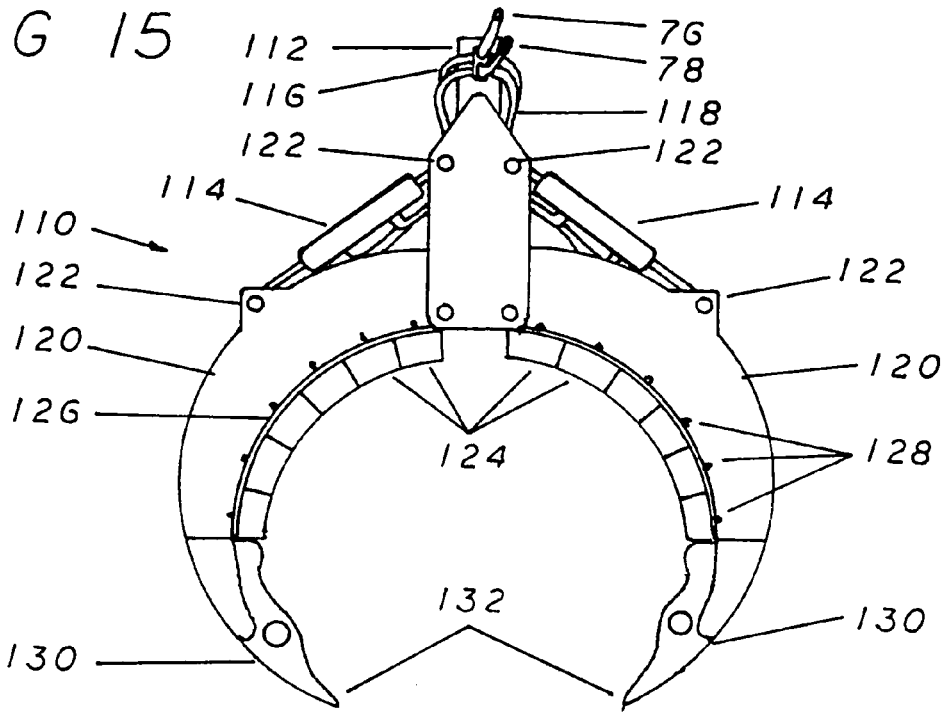
FIG. 15 is a top elevation view of the grapple claw component of the present invention illustrating it general configuration.
Figure 16:
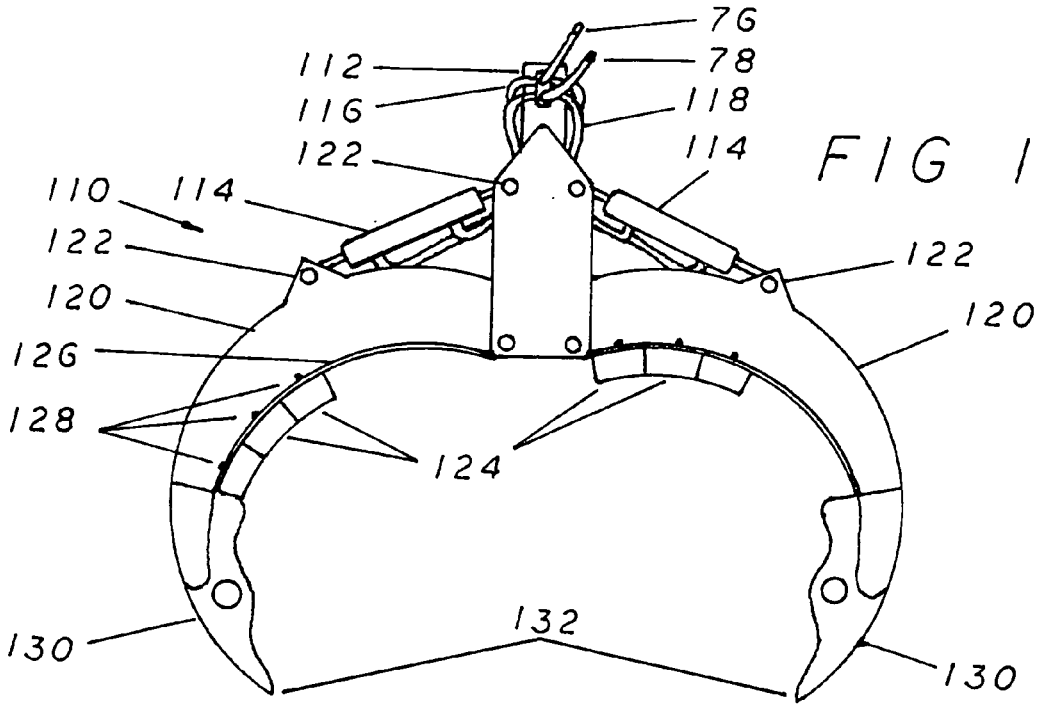
FIG. 16 is a top elevation view of the grapple claw component of the present invention illustrating its configuration when the arms are in the open configuration.

An additional auxiliary component of the present invention is the grapple claw 110 the construction of which is illustrated in FIGS. 15 and 16. The grapple claw 110 is constructed in a similar manner as the above described components in that it is designed to interact with the variable boom 30 apparatus and employ the hydraulic system of the skid steer loader 12 for its operations. The grapple claw 110 is another claw-like apparatus employed by the present invention having a central grapple body 112 to which are pivotally attached two opposing grapple arms 120. The pivotal attachment of the grapple arms 120 is critical to the operation of the grapple claw 110 as it allows for their articulation which facilitates its ability to grasp and manipulate objects.

The articulation of the grapple arms 120 is accomplished by the use of the grapple hydraulic cylinders 114. The grapple hydraulic cylinders 114 are positioned within the grapple claw 110 so that their inward ends are pivotally attached to the outside edges of the grapple body 112 at the cylinder anchors 122. Additionally, the outer ends of the grapple hydraulic cylinders 114 are in turn pivotally attached to the outer surface of the corresponding grapple arms 120 at additional cylinder anchors 122. This method of construction enables the grapple arms 120 to be articulated around their pivotal attachment to the grapple body 112 through the operation of the grapple hydraulic cylinders 114. Thus, the contraction and expansion of the grapple hydraulic cylinders 114 serves to open and close the grapple arms 120 in order to fit the requirements of a given situation. The hydraulic pressure necessary to operate the grapple hydraulic cylinders 114 is supplied by the skid steer loader 12 through the hydraulic pressure and return lines, 76 and 78 of the present invention which connect to a hydraulic selector valve located on the grapple body 112. This hydraulic selector vale contains a double check valve having the same purpose and functioning in much the same manner as described above for the ball hydraulic valve system release 29. This hydraulic pressure is then transferred to the grapple hydraulic pressure and return lines, 116 and 118, which feed it to and from the grapple hydraulic cylinders 114.

The two grapple arms 120 of this component of the present invention are generally of a hemispherical shape the inside surfaces of which are lined with a plurality of removable grasping teeth 124. The removable grasping teeth 124 function to provide the grapple claw 110 with a greater ability to grasp and lift cylindrical or spherical objects and as such are commonly constructed from a material such as a durable form of rubber. However, in some circumstances it is desirable to employ a system of gripping teeth 124 that are more durable in nature. The removable nature of the grasping teeth 124 provides a means by which they can be changed out to fit specific needs thereby enhancing the flexibility of the invention.

To facilitate the removable function of the grasping teeth 124 a plurality of individual teeth are each individually mounted to a teeth attachment plate 126 that lines the inner surface of the grapple arms 120. This mounting is accomplished by the use of teeth attachment bolts 128 that extend from the rear surface of the grasping teeth 124 and pass through the teeth attachment plate 126. This manner of construction not only allows the operator of the present invention to alter the composition of the grasping teeth 124 to fit specific needs, but also to use a less than complete number of grasping teeth 124 in situations where this approach is necessary.

Additionally, the terminal end of each of the grapple arms 124 are equipped with inwardly extending penetration teeth 130 which are configured in such a manner so that when the grapple arms 120 are in the partially opened position, there is a remaining gap between the opposing penetrating teeth 130. Also, the penetrating teeth 130 extend further inward than the grasping teeth 124 and function not only to grasp objects by puncturing them, but also to help retain objects that are held within the area defined by the inner surfaces of the grapple arms 120. The penetrating teeth 130 also contain a canister hole into which a suppression agent, such as tear gas, may be placed. Finally, the penetrating teeth 130 terminate at relatively sharp penetrating tips 132 which facilitate the puncturing function of the penetrating teeth 130.

The grapple claw 110 allows the operator of the present invention to grasp and manipulate objects remotely thereby eliminating dangers associated with the procedure. Additionally, it is designed in such a manner so that the grapple arms 120 may be closed to such an extent that they interlock allowing the grapple claw 110 may grasp and manipulate objects that are significantly smaller than the radius defined by the outer surface of the grasping teeth 124. Thus, the present invention represents an entire tool system designed to provide safe options to those members of government agencies that are presented with situations where it is necessary to monitor conditions hidden by an enclosed wall or to provide a means of entry when it becomes absolutely necessary. Additionally, the present invention is designed in such a manner so that each of its components function perfectly with all of the others and they all can be accessed and interchanged with the greatest possible ease.

Although the present invention has been described in considerable detail with reference to certain preferred versions thereof, other versions are possible. For example, the type of tractor used may vary greatly. Therefore, the spirit and scope of the appended claims should not be limited to the description of the preferred versions contained herein.

What is claimed is:

1. A tactical boom assembly for use on a front end loader having first and second loader arms said tactical boom assembly comprising:

an attachment assembly removably attachable to said first and second loader arms;

a pivot plate pivotally attached to said attachment assembly said pivot plate extending toward said first and second loader arms with a first and second pivot hydraulic cylinder each of said first and second cylinders having a first end attached to said pivot plate and a second end attached to said attachment assembly such that said first and second cylinders control the pivotal position of said pivot plate;

a hydraulic valve on said attachment assembly for controlling the first and second pivotal cylinders and for attaching implements to said attachment assembly;

a receiver shaft centered on said pivot plate; and a first elongate boom section having a first end removably attached to said receiver shaft and a second end for receiving an implement.

2. A tactical boom assembly as in claim 1 for use on a front end loader having first and second loader arms said tactical boom assembly further comprising an attachment assembly cover for protecting said first and second pivot hydraulic cylinders.

3. A tactical boom assembly as in claim 2 for use on a front end loader having first and second loader arms said tactical boom assembly further comprising a pressure relief valve attached to said hydraulic valve.

4. A tactical boom assembly as in claim 3 for use on a front end loader having first and second loader arms said tactical boom assembly further comprising:

a claw head having a claw head body removably attached to said second end of said boom assembly;

a lower claw member extending outward from said claw head and a upper claw member pivotal attached to said claw head such that said upper claw member can pivot between an open and closed position relative to said lower claw member;

a claw hydraulic cylinder with a first end pivotally attached to said upper claw member and a second end pivotally attached to said claw head such that the expansion and contraction of said claw hydraulic cylinder moves said upper claw member between said closed and open positions.

5. A tactical boom assembly as in claim 4 for use on a front end loader having first and second loader arm said tactical boom assembly further comprising a central cavity formed by said upper claw member, said central cavity having a camera pointing out of a lens opening formed by said central cavity.

6. A tactical boom assembly as in claim 5 for use on a front end loader having first and second loader arm said tactical boom assembly further comprising a cannister cylinder formed by said lower claw member said cannister cylinder having a first and second open end.

7. A tactical boom assembly as in claim 6 for use on a front end loader having first and second loader arm said tactical boom assembly further comprising a battering ram plate attached to said upper claw member.

8. A tactical boom assembly as in claim 7 for use on a front end loader having first and second loader arm said tactical boom assembly further comprising a plurality of teeth on said upper and lower claw members.

9. A tactical boom assembly as in claim 8 for use on a front end loader having first and second loader arm said tactical boom assembly further comprising a second boom assembly attached between said first elongate boom section and said claw head body.

10. A tactical boom assembly as in claim 3 for use on a front end loader having first and second loader arm said tactical boom assembly further comprising:

a grapple arm body removably attached to said second end of said boom assembly;

a first and second grapple arm pivotally attached to said grapple arm body;

a first grapple arm cylinder pivotally attached between said grapple arm body and said first grapple arm; and a second grapple arm cylinder pivotally attached between said grapple arm body and said second grapple arm, such that said first and second grapple arm cylinders can move said first and second grapple arms in unison between an open and closed position.

11. A tactical boom assembly as in claim 3 for use on a front end loader having first and second loader arm said tactical boom assembly further comprising a boomed pick apparatus having a downwardly extending pick arm, said boomed pick apparatus being removably attached to said second end of said boom assembly.

12. A tactical boom assembly for use on a front end loader having first and second loader arms said tactical boom assembly comprising:

an attachment assembly removably attachable to said first and second loader arms;

a pivot plate pivotally attached to said attachment assembly said pivot plate extending toward said first and second loader arms with a first and second pivot hydraulic cylinder each of said first and second cylinders having a first end attached to said pivot plate and a second end attached to said attachment assembly such that said first and second cylinders control the pivotal position of said pivot plate;

a hydraulic valve on said attachment assembly for controlling the first and second pivotal cylinders and for attaching implements to said attachment assembly;

a receiver shaft centered on said pivot plate;

a first elongate boom section having a first end removably attached to said receiver shaft and a second end for receiving an implement;

a claw head having a claw head body removably attached to said second end of said boom assembly;

a lower claw member extending outward from said claw head and a upper claw member pivotal attached to said claw head such that said upper claw member can pivot between an open and closed position relative to said lower claw member; and a claw hydraulic cylinder with a first end pivotally attached to said upper claw member and a second end pivotally attached to said claw head such that the expansion and contraction of said claw hydraulic cylinder moves said upper claw member between said closed and open positions.

13. A tactical boom assembly as in claim 12 for use on a front end loader having first and second loader arms said tactical boom assembly further comprising a central cavity formed by said upper claw member, said central cavity having a camera pointing out of a lens opening formed by said central cavity.

14. A tactical boom assembly as in claim 13 for use on a front end loader having first and second loader arms said tactical boom assembly further comprising a cannister cylinder formed by said lower claw member said cannister cylinder having a first and second open end.

15. A tactical boom assembly as in claim 14 for use on a front end loader having first and second loader arm said tactical boom assembly further comprising a battering ram plate attached to said upper claw member.

16. A tactical boom assembly as in claim 15 for use on a front end loader having first and second loader arm said tactical boom assembly further comprising a plurality of teeth on said upper and lower claw members.

17. A tactical boom assembly as in claim 16 for use on a front end loader having first and second loader arm said tactical boom assembly further comprising a second boom assembly attached between said first elongate boom section and said claw head body.

* * * * *